US011484119B1

(12) United States Patent
Yang

(10) Patent No.: US 11,484,119 B1
(45) Date of Patent: Nov. 1, 2022

(54) PISTOL RACK

(71) Applicant: EOSEN LLC, Monterey Park, CA (US)

(72) Inventor: Zijiang Yang, Fontana, CA (US)

( * ) Notice: Subject to any disclaimer, the term of this patent is extended or adjusted under 35 U.S.C. 154(b) by 0 days.

(21) Appl. No.: 17/511,215

(22) Filed: Oct. 26, 2021

(51) Int. Cl.
*A47B 81/00* (2006.01)
*F41A 23/18* (2006.01)

(52) U.S. Cl.
CPC ..... *A47B 81/005* (2013.01); *F41A 23/18* (2013.01)

(58) Field of Classification Search
CPC ..... A47B 81/00; A47B 81/005; F41A 23/18; B60R 7/14
See application file for complete search history.

(56) References Cited

U.S. PATENT DOCUMENTS 2,620,929 A * 12/1952 Sportsman ..... A47B 65/00 211/69.5
2,740,530 A * 4/1956 Ponder ..... F41A 23/18 89/37.04
2,939,587 A * 6/1960 Kondziolka ..... A47B 81/005 211/64
2,959,293 A * 11/1960 Von Meyer ..... G11B 33/0433 211/49.1
3,031,069 A * 4/1962 Hirsch ..... F41C 33/06 211/64
3,329,278 A * 7/1967 Pachmayr ..... F41A 23/18 248/68.1
3,356,229 A * 12/1967 Rhymes, Jr. ..... A24F 9/14 211/70.3
3,731,818 A * 5/1973 Young ..... A47B 81/005 211/64
3,913,746 A * 10/1975 Burton ..... A47B 81/005 211/64
4,537,315 A * 8/1985 Griffin ..... A47G 21/14 248/37.3
4,970,006 A * 11/1990 Martinez ..... A47G 21/14 248/37.3
5,193,680 A * 3/1993 Schumann ..... B65H 49/325 206/394
5,228,578 A * 7/1993 Wu ..... A47B 65/15 211/175
5,332,106 A * 7/1994 Schlotte ..... A47G 21/14 211/49.1
5,720,193 A * 2/1998 Dick ..... F41A 17/54 70/164
5,850,784 A * 12/1998 Conner ..... A47J 47/005 248/37.3
D500,638 S * 1/2005 Srivastava ..... D7/601
7,448,506 B2 * 11/2008 Berti ..... A47G 21/14 248/37.3
7,584,861 B2 9/2009 Werner
D632,901 S * 2/2011 Christoffel ..... D6/683
7,934,610 B2 * 5/2011 Zeng ..... A47G 21/14 211/70.7
8,955,697 B2 * 2/2015 Spilotro ..... A47B 81/00 D3/262
9,383,179 B1 * 7/2016 Spilotro ..... B65D 25/06
10,151,559 B2 * 12/2018 Higgins ..... F41C 33/0209
10,234,235 B2 * 3/2019 Higgins ..... F41A 23/02
10,697,727 B2 6/2020 Higgins (Continued)

*Primary Examiner* — Stanton L Krycinski

(57) ABSTRACT

A pistol rack having counterweight plates on the front and bottom of the rack shifts the center of gravity of the rack to facilitate more balanced carrying of the rack having pistols in the compartments thereof.

11 Claims, 5 Drawing Sheets

(56) References Cited

U.S. PATENT DOCUMENTS

| | | | | |
|---|---|---|---|---|
| 11,064,841 | B2 * | 7/2021 | Nathan | A47B 81/04 |
| 2008/0060205 | A1 * | 3/2008 | Schmidt | A47G 21/14<br>30/298.4 |
| 2014/0183148 | A1 * | 7/2014 | Ho | A47J 47/16<br>211/49.1 |
| 2022/0017017 | A1 * | 1/2022 | Mueller | F41A 23/18 |

* cited by examiner

PISTOL RACK

FIELD OF THE INVENTION

The invention relates to a rack that supports one or more pistols.

BACKGROUND OF THE INVENTION

Handgun racks are useful to support handguns for storage, at the cleaning bench, or on the range. A good rack can keep the pistols spaced apart in less space than if each was laid out on a table top.

It would be desirable, however, to have a pistol rack that would work for both long and short-barreled handguns with a proper weighting that the rack would not tend to tilt backward or forward when fully loaded.

It would also be desirable to have a pistol rack that provided handles or handle openings so that the rack and pistols therein could be carried in a balanced manner.

SUMMARY OF THE INVENTION

It is an object of the invention to provide a pistol rack that is well-balanced, even when holding a plurality of pistols of varying barrel length and weight.

It is a further object of the invention that can be carried without tipping to the front or the rear.

In accordance with these and other objects of the invention that will become apparent from the description herein, a rack according to the invention comprises:

- a first upstanding, outer sidewall member having a grippable opening therein;
- a second upstanding, outer sidewall member having a grippable opening therein;
- a first outer sidewall counterweight plate having a weight sufficient to shift a center of gravity of said rack toward a front and/or a bottom of said rack;
- a second outer sidewall counterweight plate having a weight sufficient to shift a center of gravity of said rack toward a front and/or a bottom of said rack;
- one or more upstanding, inner wall members;
- one or more generally L-shaped support members that each comprise: (i) a bottom portion having a first length and dimensioned to support a heel portion of a handgun grip, and (ii) a forward portion that is transverse and upstanding relative to the bottom portion, said forward portion having a second length that is less than the first length of the bottom portion and a top support surface of sufficient width to support a bottom of a handgun barrel;
- a plurality of connecting members that extend through said a first outer sidewall counterweight plate; said first upstanding, outer sidewall member; at least one of the generally L-shaped support members; at least one of the inner wall members; said second upstanding, outer sidewall member; and said second outer sidewall counterweight plate thereby connecting each in a side-by-side relationship that form at least two discrete, side-by-side, support compartments;
- wherein a first connector member extends through the bottom portion of the L-shaped support member, and a second connector member extends through the forward portion of the L-shaped support member.

Portable pistol racks according to the present invention provide a weight

DETAILED DESCRIPTION OF THE INVENTION

Figure 1:
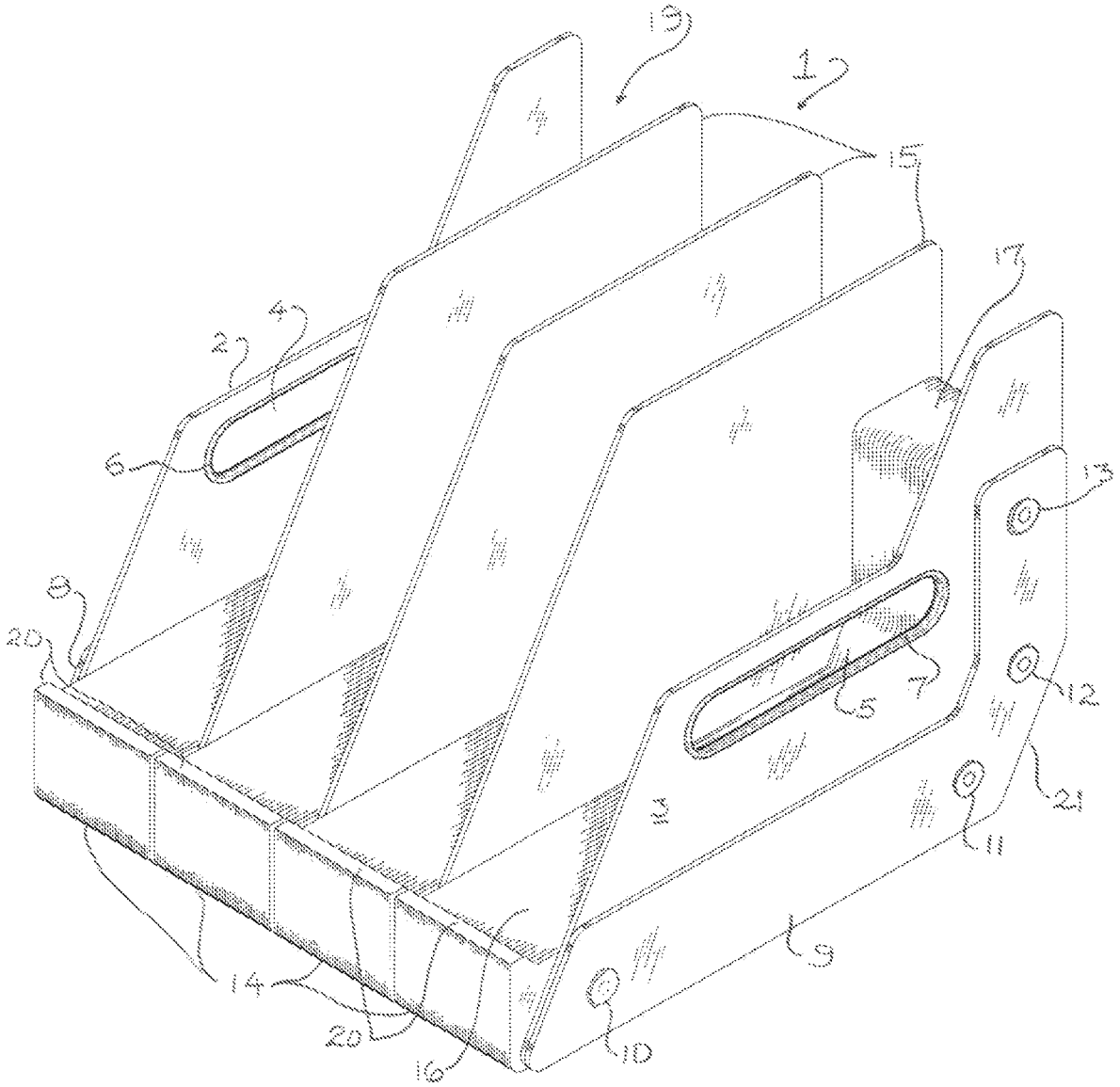
FIG. 1 shows a preferred embodiment of the invention.
Figure 2:
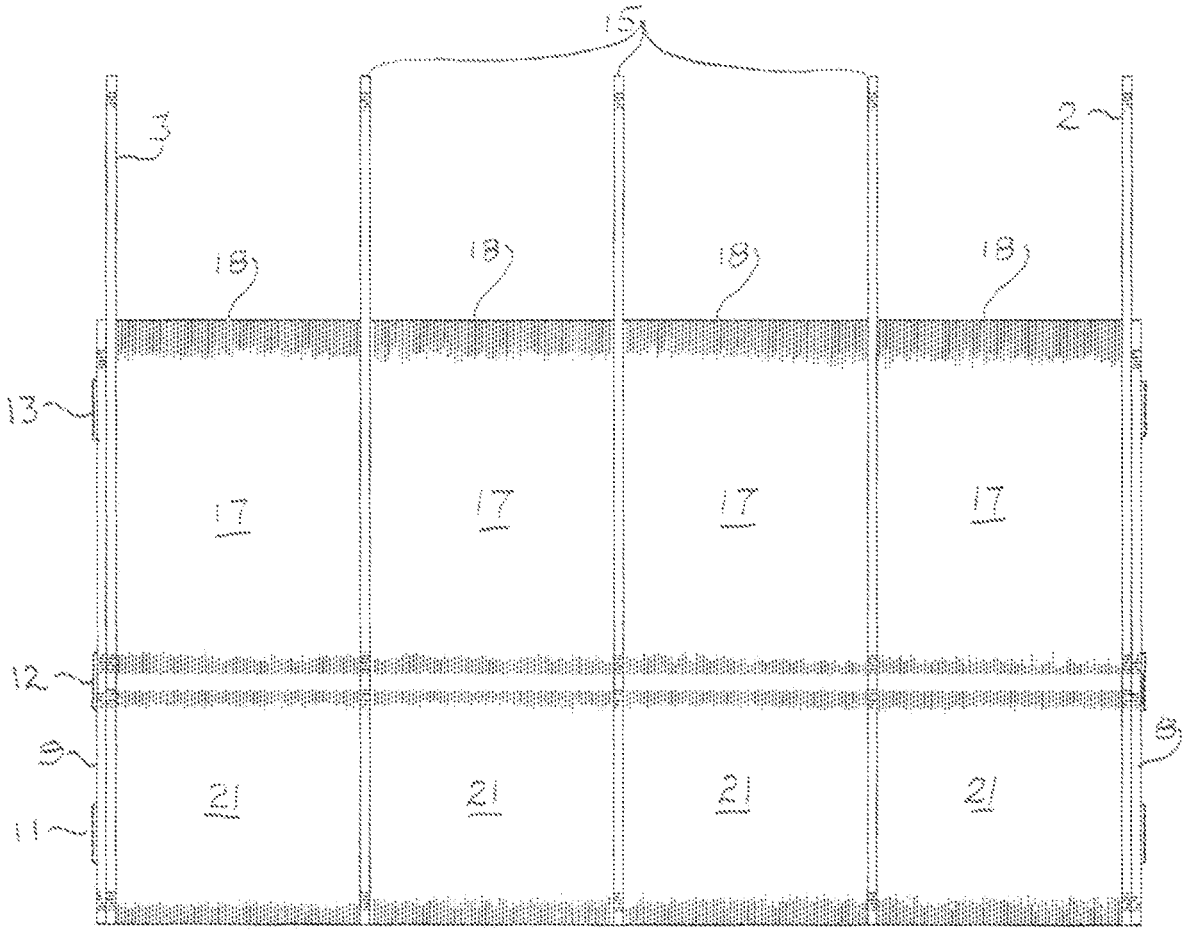
FIG. 2 presents a view from the rear of a rack according to the invention.
Figure 3:
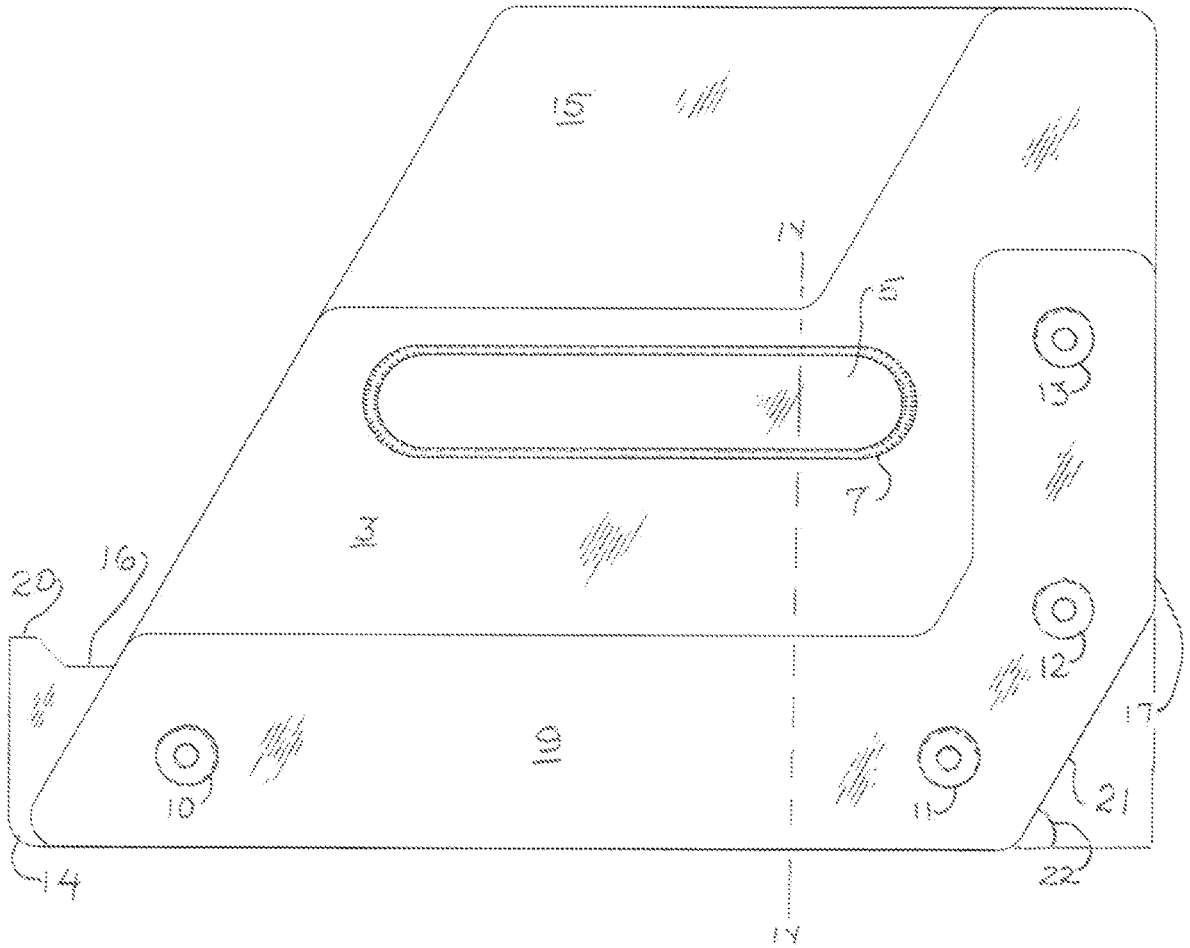
FIG. 3 is a side view showing the shapes of the end walls and the interior dividing walls.
Figure 4:
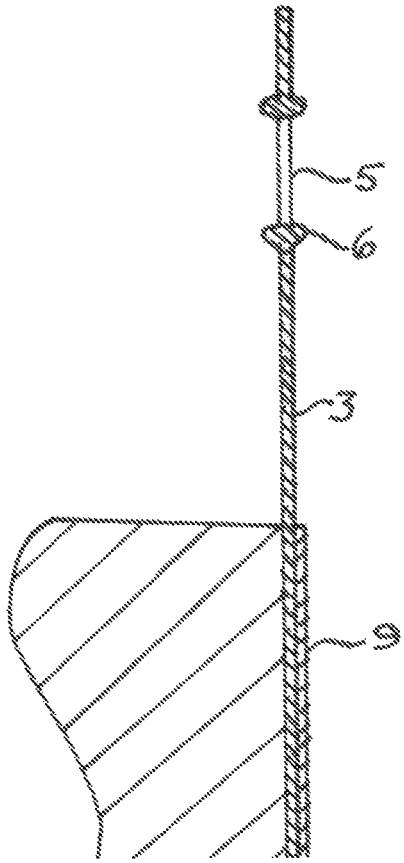
FIG. 4 is a sectional view of an outer sidewall having a reinforced handle opening therein and an adjacent counterweight plate.
Figure 5:
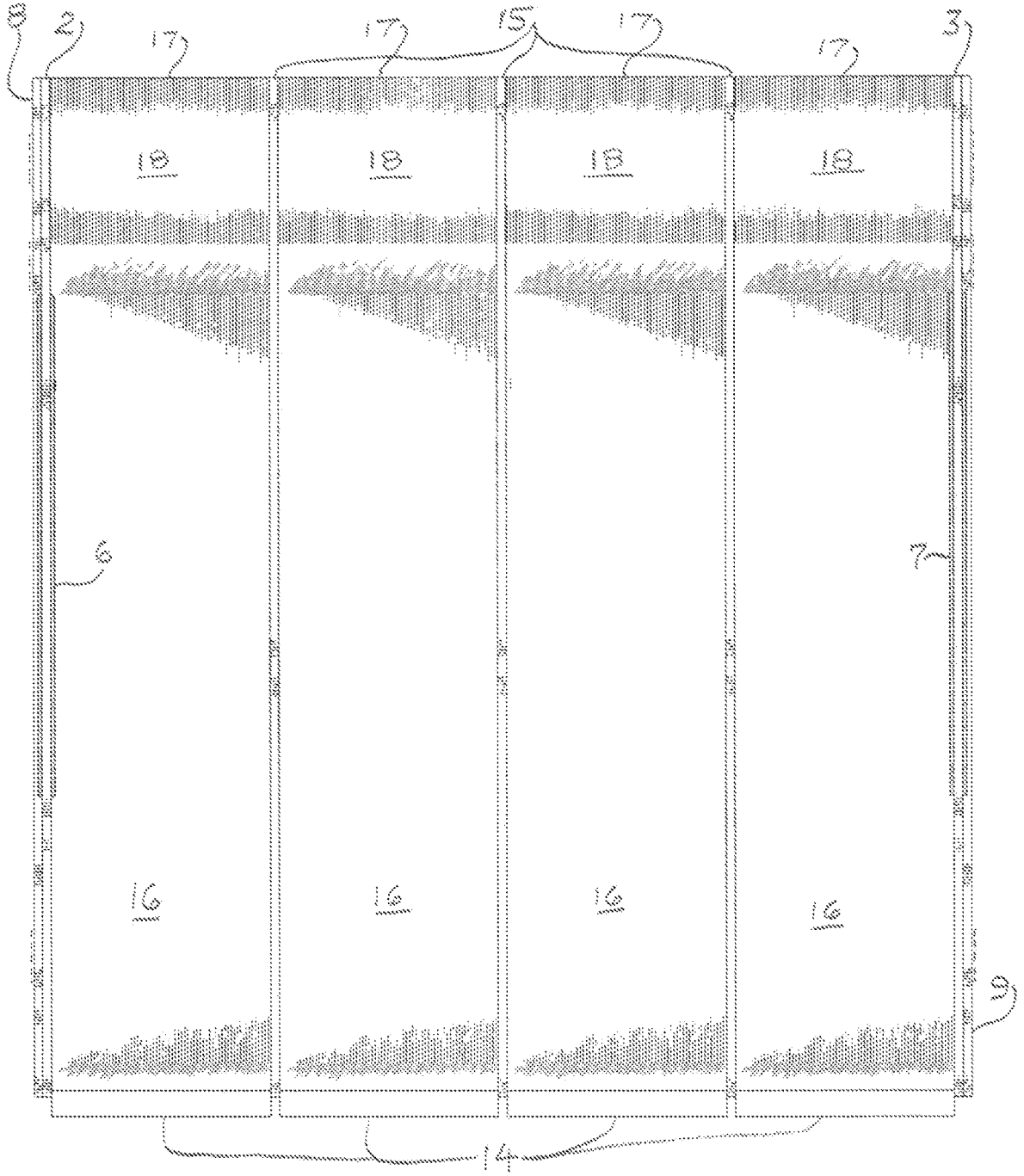
FIG. 5 is a top view showing the forward support and the rearward retention flange.

As shown in the figures, pistol rack 1 includes a pair of opposing first and second outer sidewalls 2, 3 having grippable, first and second handle openings 4, 5 therein. Handle openings 4, 5 are reinforced by ridges 6, 7 around substantially the entire perimeter of each opening thereby presenting the user's gripping hand with a substantially flat lip of greater thickness than the sidewall 2, 3.

Along the bottom and front of each outer sidewall 2, 3 is a counterweight plate 8, 9 held in place next to each outer sidewall 2, 3 with one or more connecting members, such as threaded metal rods 10, 11, 12, and 13 that are of sufficient length to extend through plates 8, 9, outer sidewalls 2, 3, each supporting member 14 and each interior sidewall 15. Counterweight plates 8, 9 are preferably made from a single piece of metal for added weight and rigidity, but is also possible to use two or even three individual plates to serve the same functions as single counterweight plates.

A variety of possible threaded end caps 16 can then be used to removably secure rods 10-13 in position against counterweight plate 8, 9. End caps 16 are preferably a form of flange cap in which a threaded portion of the cap extends into the openings through the counterweight plate, outer sidewall, and the outermost support member to connect with the threaded rod while the flange portion of the cap is larger than the formed hole in the counterweight plate. As the cap is threaded onto the rod, the flange portion of the cap is urged against the counterweight plate to compress the support member as the cap is tightened. Close tolerances in the openings of outer sidewalls 2, 3 and in the bores through supporting members 14 and interior sidewalls 15 can exert sufficient force on the connecting members that the threaded connection will not readily disengage or become loosened with use.

In general, rack 1 can be made with 1-12 supporting members 14 and an appropriate number of interior sidewalls. Convenient sizes are preferably made with 1, 2, 4, 8, or 12 supporting members 14.

Counterweight plates 8, 9 are preferably made of a heavy metal that together represent enough weight to shift the center of gravity of the assembled rack down and/or forward. Generally, each plate desirably has a weight within the range of 50-500 grams and preferably within the range of 100-300 grams. The combined weights of the counterweight plates 8, 9, threaded rods 10-13, and caps 16 preferably represent about 50-125 wt % of the combined weights of supporting members 14, interior sidewalls 15, and outer sidewalls 2, 3. Such a weighting relationship moves the center of gravity of the assembled rack downwardly and to the front so that a rack that is full of pistols remains balanced and readily carried without having the added weights of the pistols in their position shift the rack weight to the rear and cause a tendency to tip causing the pistols to fall from the rack.

Supporting members 14 are generally L-shaped in that each has an elongated bottom portion 16 and a forward portion 17 that is transverse to and upstanding relative to the bottom portion 16. The top of forward portion 17 forms support surface 18 for the bottom of the barrel of a pistol (not shown) that would be held in the compartment 19 formed between supporting member 14 and its adjacent sidewalls, e.g., 3 and 15 or adjacent inner sidewalls 15.

Supporting members 14 are generally made of a closed cell foam having a uniform, single, density across this part.

The length of bottom portion 16 has a first length that is generally 1.25-2.5 times the height of forward portion 17 or otherwise dimensioned to support pistols of varying length in slot 19 with the heel of the pistol handle resting on bottom portion 14 forward of rear flange 20 and the bottom of the pistol barrel resting on support surface 18.

The illustrated embodiment shows support member 14 with an angled portion 21 between the bottom of forward portion 17 and the forward end of bottom portion 16. Angled portion 21 is desirably formed at an angle 22 within the range of 45° to 80°, preferably about 60-70°, relative to the bottom plane of support member 14. This same angle is also found in each inner sidewall, each outer sidewall, and each counterweight plate segment at that location. The shifted center of gravity afforded by the present invention and the alignment of the angled portion between the bottom and front of the rack components forms an angled plane that allows rack 1 to be rotated forward onto the generally planar surface formed by adjacent angled portions 21 into a canted orientation. This orientation allows a somewhat more convenient angle when a user seeks to grasp the handle of a pistol when the rack located on a lower shelf in a storage safe or cabinet or from a lower table at a range.

It will be understood that the appended claims are not to be limited to the description above of a preferred embodiment according to the invention.

What is claimed is:

1. A portable rack configured to carry and store handguns, said rack comprising:

a first upstanding, outer sidewall member having a grippable opening therein;

a second upstanding, outer sidewall member having a grippable opening therein;

a first outer sidewall counterweight plate having a weight sufficient to shift a center of gravity of said rack toward a front and/or a bottom of said rack;

a second outer sidewall counterweight plate having a weight sufficient to shift a center of gravity of said rack toward a front and/or a bottom of said rack;

one or more upstanding, inner wall members;

one or more generally L-shaped support members that each comprise: (i) a bottom portion having a first length and dimensioned to support a heel portion of a handgun grip, and (ii) a forward portion that is transverse and upstanding relative to the bottom portion, said forward portion having a second length that is less than the first length of the bottom portion and a top support surface of sufficient width to support a bottom of a handgun barrel;

a plurality of connecting members that extend through said first outer sidewall counterweight plate; said first upstanding, outer sidewall member; at least one of the generally L-shaped support members; at least one of the inner wall members; said second upstanding, outer sidewall member; and said second outer sidewall counterweight plate thereby connecting each in a side-by-side relationship that to form at least two discrete, side-by-side, support compartments;

wherein a first connector member extends through the bottom portion of the L-shaped support member, and a second connector member extends through the forward portion of the L-shaped support member.

2. A portable rack according to claim 1 wherein each counterweight plate exhibits a weight within a range from about 100 grams to 300 grams.

3. A portable rack according to claim 1 comprising 1 to 12 of the generally L-shaped support members.

4. A portable rack according to claim 3 comprising 4, 8, or 12 of the generally L-shaped support members.

5. A portable rack according to claim 1 wherein each counterweight plate is a single piece.

6. A portable rack according to claim 5 wherein each counterweight plate has a lower portion, a forward portion that is transverse to said lower portion, and an angled portion between the lower and forward portions.

7. A portable rack according to claim 1 wherein each L-shaped support member is made of a single density foam.

8. A portable rack according to claim 1 wherein the first and second connectors are threaded metal rods.

9. A portable rack according to claim 1 wherein each L-shaped support member further comprises an upward flange at a rear portion of said support member.

10. A portable rack according to claim 1 wherein adjacent portions of the outer sidewall members and of said one or more upstanding, inner wall members are longer than the forward portion of each L-shaped support member when assembled.

11. A portable rack according to claim 1 wherein each generally L-shaped member further comprises an angled portion between said bottom portion and said forward portion having an angle (22) within the range of 45° to 80° relative to a bottom plane of each generally L-shaped support member.

* * * * *